US007237517B2

(12) United States Patent
Lehmann et al.

(10) Patent No.: US 7,237,517 B2
(45) Date of Patent: Jul. 3, 2007

(54) CAMSHAFT ADJUSTER OF AN INTERNAL COMBUSTION ENGINE

(75) Inventors: Kai Lehmann, Ludwigsfelde (DE); Jörg Rösener, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 97 days.

(21) Appl. No.: 11/133,456

(22) Filed: May 19, 2005

(65) Prior Publication Data

US 2005/0257764 A1 Nov. 24, 2005

(30) Foreign Application Priority Data

May 19, 2004 (DE) ..... 10 2004 024 690

(51) Int. Cl.
*F01L 1/34* (2006.01)

(52) U.S. Cl. ..... 123/90.17; 123/90.15

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS

| | | | | |
|---|---|---|---|---|
| 5,450,825 | A * | 9/1995 | Geyer et al. | 123/90.17 |
| 6,779,501 | B2 * | 8/2004 | Simpson et al. | 123/90.17 |
| 7,025,023 | B2 * | 4/2006 | Lehmann et al. | 123/90.17 |

FOREIGN PATENT DOCUMENTS

| | | |
|---|---|---|
| DE | 36 19 956 | 12/1987 |
| DE | 43 11 264 | 10/1994 |
| DE | 199 05 234 | 8/2000 |
| DE | 101 20 451 | 10/2001 |

* cited by examiner

*Primary Examiner*—Ching Chang
(74) *Attorney, Agent, or Firm*—Klaus J. Bach

(57) ABSTRACT

In a camshaft adjuster for an internal combustion engine comprising a control valve having a control piston slidably supported in a valve housing, an operating unit for adjusting the angular position of the camshaft relative to a crankshaft of the engine and a drive unit with an electric motor and a transmission structure for actuating the control piston, the transmission is non-self-locking so that backward movement of the valve piston can be achieved by a backward force on the valve piston.

19 Claims, 4 Drawing Sheets

CAMSHAFT ADJUSTER OF AN INTERNAL COMBUSTION ENGINE

BACKGROUND OF THE INVENTION

The invention resides in a camshaft adjuster for an internal combustion engine including a control valve with a valve housing in which a control spool is disposed for controlling the supply of hydraulic fluid to an actuating unit for adjusting the angular position of the camshaft relative to the crankshaft of the engine, the control spool being operable by an electric motor and a transmission structure.

For reducing the fuel consumption and raw emissions and increasing the power output and torque, internal combustion engines generally include control devices for adjusting the angular position of the camshaft relative to the crankshaft. At this time, mostly hydraulic vane cell adjusters including hydraulic actuating chambers are used. The angular adjustment of the camshaft is achieved by the controlled admission of hydraulic oil from the engine lubricating circuit to the chambers of the hydraulic vane cell adjuster by means of a control valve. The control valve is operated by an electromagnetic device.

DE 36 19 956 discloses a camshaft adjuster of an internal combustion engine with a control valve which is disposed in the camshaft and which includes a control piston disposed in a valve housing. The camshaft is provided with an operating unit for adjusting the angular position of the camshaft relative to the crankshaft of the engine under the control of the control valve. The control piston is actuated by an operating unit which includes an electric motor; and a motion transmission structure which moves the control piston in an advancing or retarding direction. As operating unit, an electric motor with an operating rod, which is capable of axially moving the control piston, is used. The use of the operating rod however requires an expensive control arrangement for the positioning of the operating rod since the motor must be energized for the back and forward movement of the operating rod.

It is therefore the object of the present invention to provide a camshaft adjustor for an internal combustion engine having a simple, reliable and relatively inexpensive control arrangement for the adjustment of the angular position of the camshaft relative to the crankshaft of the engine.

SUMMARY OF THE INVENTION

In a camshaft adjuster for an internal combustion engine comprising a control valve having a control piston slidably supported in a valve housing, an operating unit for adjusting the angular position of the camshaft relative to a crankshaft of the engine and a drive unit with an electric motor and a transmission structure for actuating the control piston, the transmission structure is not self-locking so that backward movement of the valve piston can be achieved by a backward force on the valve piston.

It is an important advantage of the camshaft adjuster according to the invention that, for the positioning of the control piston in the control valve only a simple control structure is required. When the control structure is not energized, the control piston is biased by a return spring into a startup position of the adjuster. The drive unit is only needed for a forward movement of the control piston. The desired position of the control piston in the valve housing is obtained by a force-equilibrium of the return spring and the force generated by the drive unit. The control arrangement is therefore very simple.

Furthermore, the parts used for the control arrangement according to the invention are mass-produced standard components which are relatively inexpensive. In addition, the operation is improved since a relatively large actuating stroke can be obtained with the drive arrangement according to the invention in comparison with a conventional magnetic drive unit. Furthermore, less construction space in front of the camshaft adjuster is required in comparison with magnetic drive units for obtaining the same operating force wheel can be achieved with a drive unit having a transmission structure as proposed herein.

The invention will become more readily apparent from the following description thereof on the basis of the accompanying drawings.

DESCRIPTION OF A PARTICULAR EMBODIMENT

Figure 1:
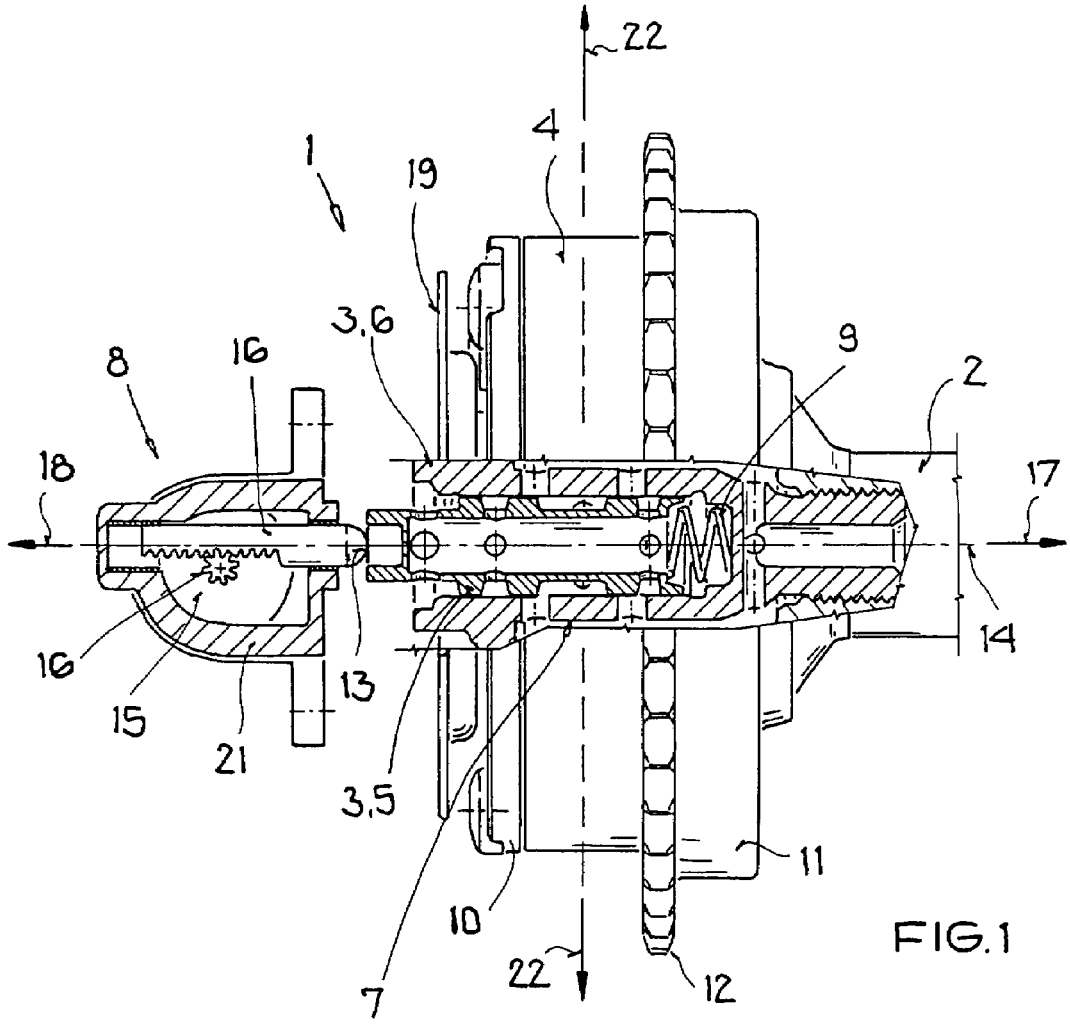
FIG. 1 is a side view of a camshaft adjuster of an internal combustion engine showing in a section a control valve with a control piston which is engaged at opposite ends by a drive unit and by a return spring.

For simplicity reasons corresponding components are designated in the various figures by the same reference numerals. Furthermore, for identical components in a figure only one component is designated by a reference numeral.

The camshaft adjuster according to FIGS. 1 to 6 is designated as a whole by the reference numeral 1 and is shown in connection with a camshaft 2 of an internal combustion engine. The adjuster 1 comprises a hydraulic control valve 3, by which an operating unit 4 for the angular adjustment of the camshaft 2 relative to the crankshaft of the internal combustion engine which is not shown can be controlled. The camshaft adjuster 1 is a hydraulic vane cell drive.

The hydraulic control valve 3 comprises control piston 5, which is movably disposed in a valve housing 6 which is disposed in a valve body 7 of the camshaft adjuster 1 and is screwed onto the camshaft 2.

At the side of the control piston 5 remote from the camshaft 2 an actuating unit 8 is arranged by which the control piston 5 is movable against the Force $F_{spring}$ of a spring structure 9.

The adjuster 4 which is controllable by the actuating unit 8 via the control piston 5 includes as control unit 4 two transfer elements which are rotationally adjustable relative to each other and arranged between a first cover 10 and a second cover 11 and include an inner body (not visible) which is connected for rotation with the camshaft and an outer body 4' which is rotatable relative to the camshaft 2. At the side of the transfer elements next to the actuating unit 8, the disc-like first cover 10 is provided with a central opening for the valve housing 6. At the side of the transfer elements remote from the actuating unit 8, there is the second cover 11 which is in the form of a drive wheel with a central opening for accommodating the camshaft 2. At its circumference the drive wheel or second cover 11 is provided with sprocket 12 which are either integrally formed with the drive wheel or separately mounted thereto and via which the drive wheel is connected for rotation with the crankshaft of the engine so as to be driven thereby. Instead of the chain drive indicated herein by the sprocket wheel of course other drive means such as a toothed belt or gear drive can be used.

The outer body 4' surrounding the camshaft 2 includes inwardly projecting vanes which are not visible. The inner body which is mounted for rotation with the camshaft 2 and which is not visible has outwardly projecting counter vanes which extend between the inwardly projecting vanes of the outer body 4'. The inner body and the outer body form, together with the covers 10, 11 at least one hydraulic operating structure which is divided by a vane into two actuating chambers.

In order to be able to transfer the drive torque of the crankshaft to the camshaft 2, the inner body of the adjuster 1 is—as already mentioned—firmly connected for rotation with the camshaft 2. The drive torque is transferred from the outer body 4' into the adjuster 1 and to the inner body via the actuating chambers. Hydraulic fluid is admitted to the respective actuating chambers by the control valve 3. By varying the hydraulic fluid volume in the actuating chambers, the phase position between the outer body 4' of the adjuster 1 and the camshaft 2 is adjustable. The control valve 3 determines, by the position of the control piston 5 in the valve housing 6, the hydraulic fluid supply to the adjuster 1 and consequently the phase position or, respectively, the change thereof. The control piston 5 is engaged by the drive unit 8 as well as by the spring 9. Advantageously, the contact point 13 between the drive unit 8 and the control piston 5 is arranged close to the axis of rotation 14 of the camshaft 1.

The drive unit 8 comprises an electric motor 15 and a transmission structure 16 in the form of a rack and pinion linear gear drive, wherein the transmission structure 16 has preferably low-friction, low wear bearings (not shown). The transmission structure 16 converts the rotation of the electric motor 15 into a linear movement or an actuating stroke. In this way, the rotational movement of the electric motor 15 can be converted to the axial movement required for the adjustment of the control piston 5 of the control valve 3 which results in movement in a forward or backward direction 17, 18 used for adjusting the control piston 5.

In accordance with the invention, the transmission 16 is not self-locking in the backward direction. The spring 9 biases the control piston in the backward direction 18.

Figure 2:
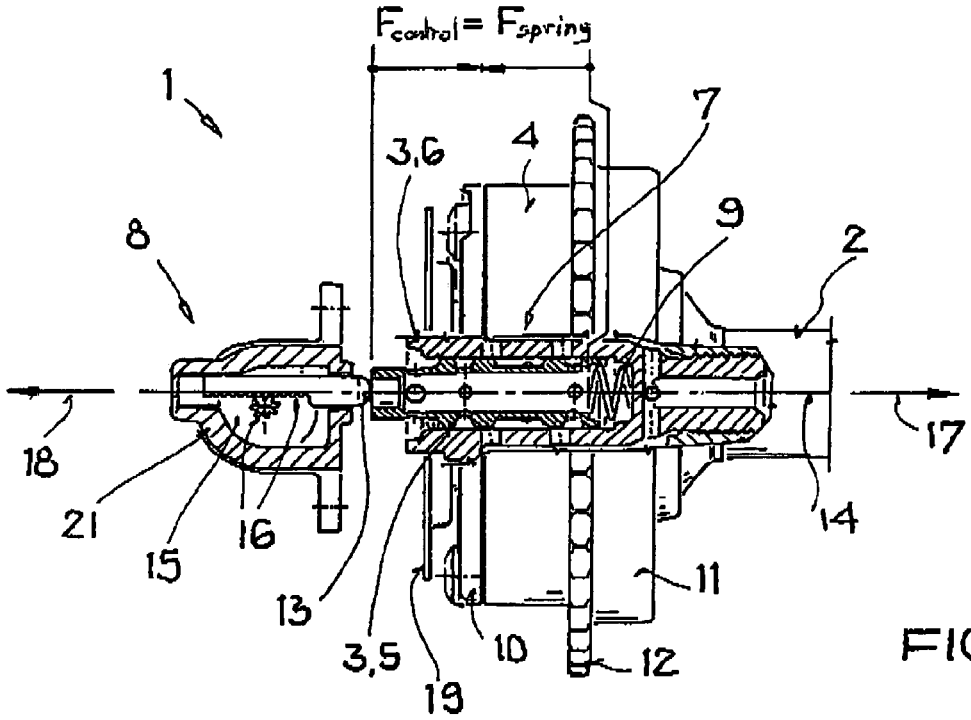
FIG. 2 shows the force equilibrium between the return spring and the operating force applied to the control piston by the drive unit.

The control piston 5 is positioned in the valve housing 6 of the control valve 3 in an equilibrium position between the spring force $F_{spring}$ of the spring arrangement 9 and the actuating force $F_{control}$ of the drive unit 8 according to FIG. 2.

Figure 3:
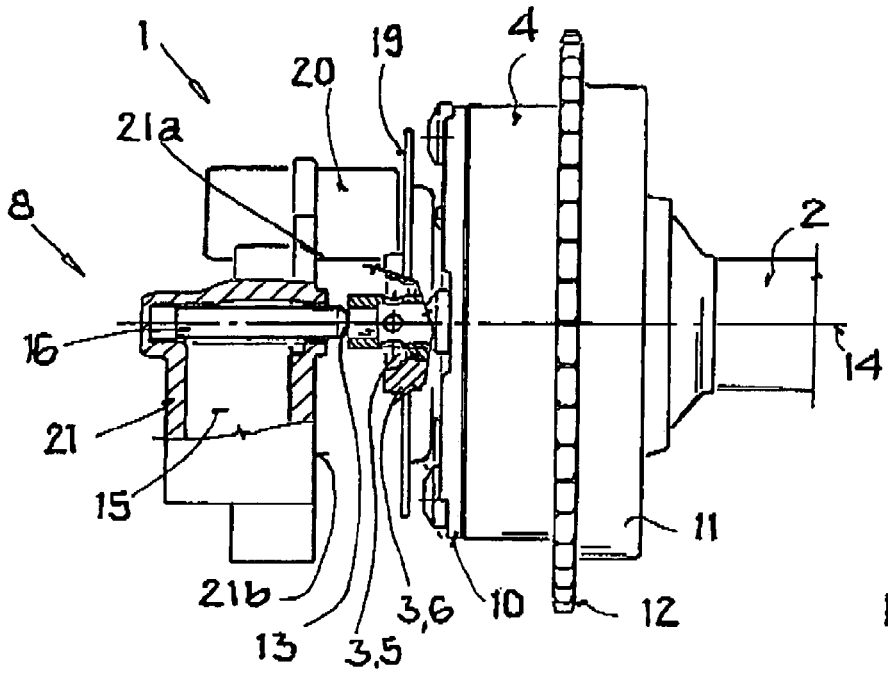
FIG. 3 shows the camshaft adjuster turned by 90° wherein additionally an arrangement for determining the position of the camshaft is provided which comprises an impulse wheel and a sensor.

FIG. 3 shows the adjuster 1 with an arrangement for determining the position of the camshaft 2 which comprises an impulse wheel 19 and a sensor 20, wherein a mounting flange of the impulse wheel 19 is disposed between the cover 10 and the drive unit 8.

Figure 4:
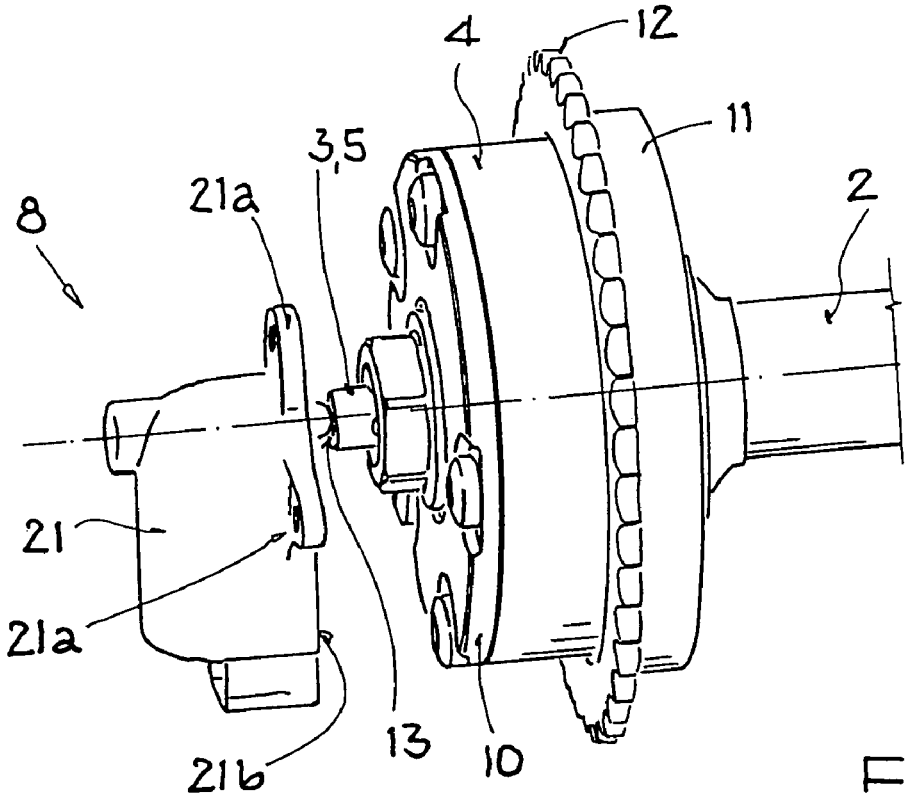
FIG. 4 shows the arrangement in an installation position without device for determining the position of the camshaft.
Figure 5:
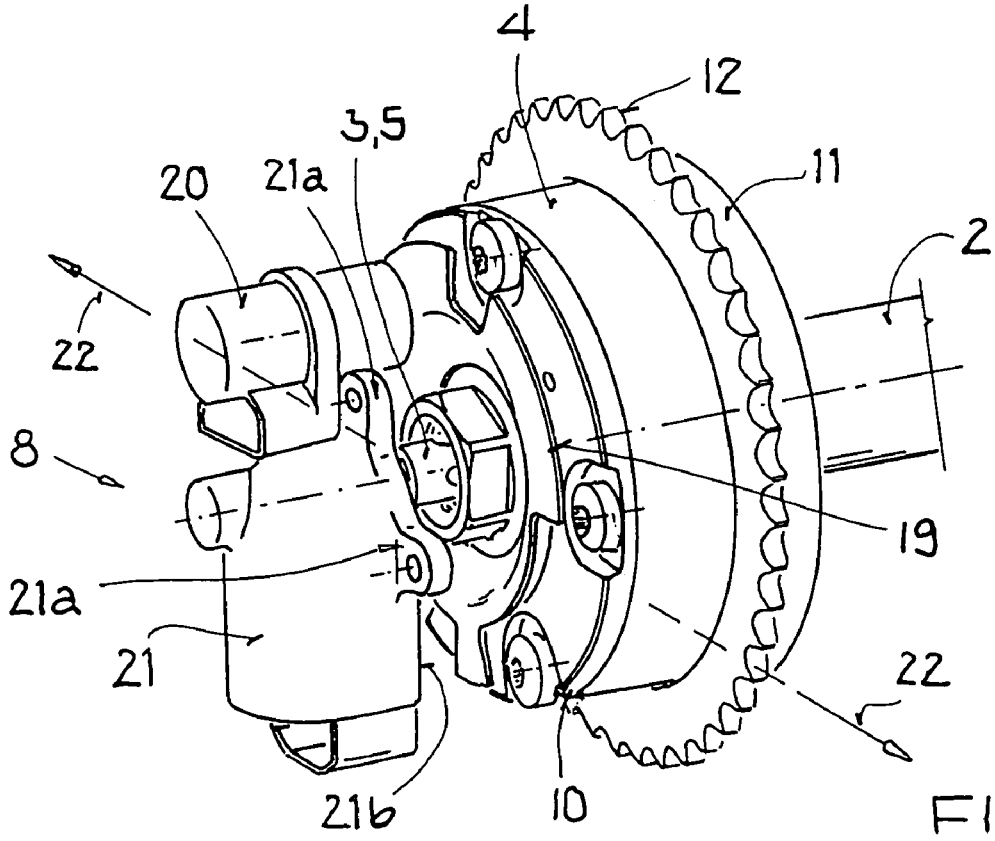
FIG. 5 shows the arrangement in installation position with device for determining the position of the camshaft.

FIGS. 4 and 5 show, in a perspective presentation the mounting arrangement of the drive unit 8 to the adjuster 1 wherein in FIG. 5 additionally the arrangement for determining the position 19, 20 of the camshaft 2 is provided.

The electric motor 15 and the transmission 16 preferably form a unit into which additionally the sensor 20 can be integrated. The electric motor 15 and the transmission 16 are arranged in a housing 21 which includes a flange 21*a* which positions and seals the drive unit 8 in axial direction 17, 18, wherein additionally the sensor 20 for determining the camshaft position is integrated into the housing 21. The housing 21 includes at the flange side 21*b* a projection which positions the drive unit in axial direction 22. Preferably, the projection is cone-shaped or cylindrical. Alternatively, the drive unit 8 may be integrated into a cover which, at the same time, has a sealing function with respect to the valve drive housing of an internal combustion engine. In another embodiment, several drive units 8 may be integrated in a cover, which have a common electrical connection, and further components such as sensors may be integrated into this common connection.

Figure 6:
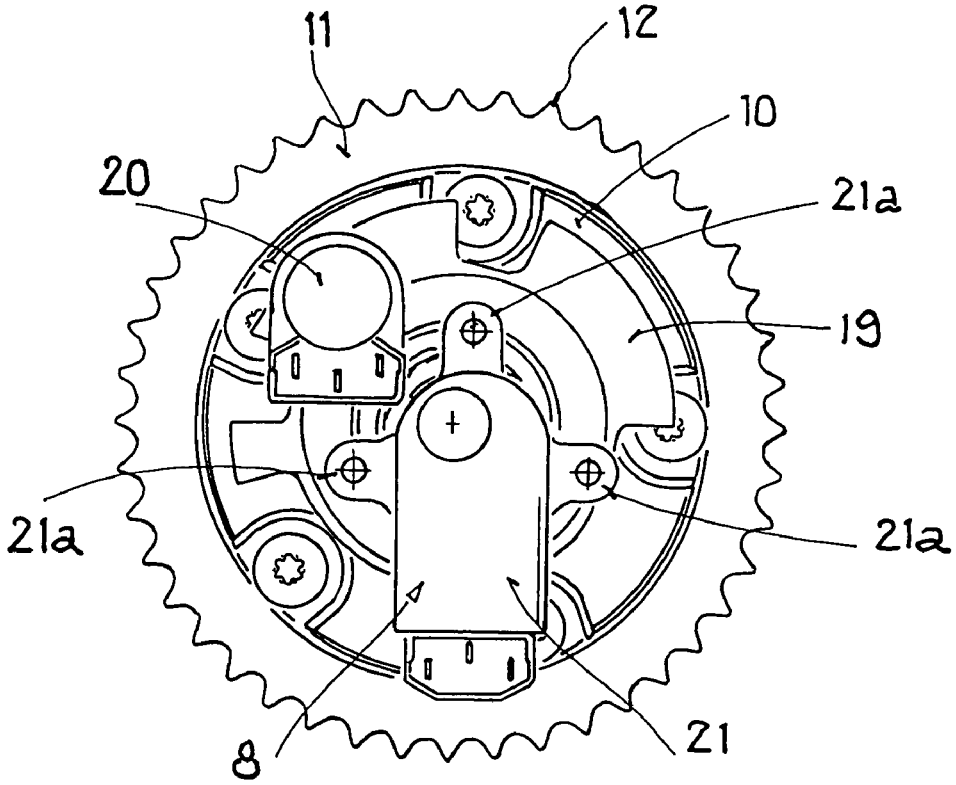
FIG. 6 is a front view of the camshaft adjuster with the position sensor.

From the front view of the adjuster 1 with the position sensor as shown in FIG. 6, it is apparent that the drive motor 15 in the housing 21 leaves sufficient space for the accommodation of the position sensor 20.

The drive unit 8 and the electric motor 15 can be controlled by way of a PWM signal. Furthermore, also a movement in an opposite direction can be initiated if a more complex control arrangement is used. That is, the drive unit can be so designed that the electric motor can be controlled and sealed for movement of the transmission member in forward or backward direction 17, 18 and the spring 9 is only provided to ensure contact between the control piston 5 and the drive element 8. In addition to the valve control function for the control of the camshaft adjuster with an increased stroke of the drive unit 8 additional functions can be realized such as a predetermined locking and unlocking function.

What is claimed is:

1. A camshaft adjuster for an internal combustion engine comprising a control valve (3) having a control piston (5) slidably supported in a valve housing (6), an operating unit (4) for adjusting the angular position of the camshaft (12) relative to the crankshaft of the internal combustion engine, a drive unit (8) with an electric motor (15) and a transmission structure (16) for moving the control piston (5) in a forward direction (17) against the force ($f_{spring}$) of a spring (9) into an equilibrium position between the force of the spring (9) and the adjustable force generated by the drive unit (8), said transmission structure (16) being non-self-locking and said spring (9) being capable of moving the control piston (15) and the drive unit (18) in a backward direction against a control force ($f_{control}$) provided by drive unit (8) in the equilibrium position.

2. A camshaft adjuster according to claim 1, wherein the camshaft adjuster (1) comprises a hydraulic vane drive.

3. A camshaft adjuster according to claim 1, wherein the control valve 3 is a multi-way valve.

4. A camshaft adjuster according to claim 1, wherein the control piston (5) is positioned in the control valve (3) by a force equilibrium between the force ($F_{spring}$) of the return spring (9) and the control force ($F_{control}$) of the drive unit (8).

5. A camshaft adjuster according to claim 1, wherein the non-self-locking transmission structure (16) is a rack and pinion drive which converts the rotational movement of the electric motor (15) into a linear stroke movement (17, 18).

6. A camshaft adjuster according to claim 5, wherein the linear stroke movement (17, 18) is transmitted to the control piston (5) via a point of contact between the transmission structure and the control piston.

7. A camshaft adjuster according to claim 5, wherein the linear stroke movement is effective in both linear directions.

8. A camshaft adjuster according to claim 1, wherein the electric motor (15) and the transmission structure (16) form a single unit.

9. A camshaft adjuster according to claim 6, wherein the point of contact between the drive unit (8) and the control piston (5) is near the axis of rotation (14) of the camshaft (2).

10. A camshaft adjuster according to claim 1, wherein the transmission structure (16) includes low wear, low friction bearings.

11. A camshaft adjuster according to claim 1, wherein the electric motor (15) and the transmission structure 16 are disposed in a housing (21) which axially positions and seals the drive unit (8).

12. A camshaft adjuster according to claim 11, wherein the housing (21) is provided at a flange side (21*b*) thereof with a projection (21*a*) for positioning the drive unit (8) in a radial direction.

13. A camshaft adjuster according to claim 12, wherein the projection is one of being conical and cylindrical.

14. A camshaft adjuster according to claim 1, wherein the drive unit (8) is integrated into a cover which, at the same time, provides for sealing toward the valve drive housing of the internal combustion engine.

15. A camshaft adjuster according to claim 1, wherein several drive units (8) are integrated into a cover which have common electrical connections.

16. A camshaft according to claim 15, wherein the common connections are connected to additional components.

17. A camshaft according to claim 1, wherein the control valve (3) is arranged in one of the camshaft (2) and the camshaft adjuster (1).

18. A camshaft according to claim 17, wherein the control valve (3) is screwed to the camshaft (2) and used to mount an inner body (7) of the camshaft adjuster (1) to the camshaft (2).

19. A camshaft according to claim 17, wherein the control valve (3) is firmly connected to at least one of the inner body (7) of the adjuster (1) and the camshaft (2).

* * * * *